US007215220B1

(12) United States Patent
Jia

(10) Patent No.: US 7,215,220 B1
(45) Date of Patent: May 8, 2007

(54) BROADBAND POWER COMBINING DEVICE USING ANTIPODAL FINLINE STRUCTURE

(75) Inventor: Pengcheng Jia, Thousand Oaks, CA (US)

(73) Assignee: Cap Wireless, Inc., Newbury Park, CA (US)

( * ) Notice: Subject to any disclaimer, the term of this patent is extended or adjusted under 35 U.S.C. 154(b) by 35 days.

(21) Appl. No.: 10/925,330

(22) Filed: Aug. 23, 2004

(51) Int. Cl.
*H01P 5/12* (2006.01)
*H01P 3/08* (2006.01)

(52) U.S. Cl. ..... 333/125; 333/128; 333/136; 333/137

(58) Field of Classification Search ..... 333/125, 333/136, 128, 127, 137; 330/286, 295
See application file for complete search history.

(56) References Cited

U.S. PATENT DOCUMENTS 4,283,685 A 8/1981 MacMaster et al.
4,291,278 A 9/1981 Quine
4,424,496 A * 1/1984 Nichols et al. ..... 330/286

(Continued)

OTHER PUBLICATIONS

Jia et al, "Broad-Band High-Power Amplifier Using Spatial Power-Combining Technique" IEEE Transactions On Microwave Theory And Techniques, vol. 51, No. 12, Dec. 2003; 0018-9480/03$1700 © 2003 IEEE pp. 2469-2475.

(Continued)

*Primary Examiner*—Robert Pascal
*Assistant Examiner*—Kimberly E Glenn
(74) *Attorney, Agent, or Firm*—Thelen Reid Brown Raysman & Steiner LLP; Khaled Shami

(57) ABSTRACT

A broadband power combining device includes an input port, an input waveguide section, a center waveguide section formed by stacked wedge-shaped trays, an output waveguide section, and an output port. Each tray is formed of a wedge-shaped metal carrier, an input antipodal finline structure, one or more active elements, an output antipodal finline structure, and attendant biasing circuitry. The wedge-shaped metal carriers have a predetermined wedge angle and predetermined cavities. The inside and outside surfaces of the metal carriers and surfaces of the cavity all have cylindrical curvatures. When the trays are assembled together, a cylinder is formed defining a coaxial waveguide opening inside. The antipodal finline structures form input and output arrays. An incident EM wave is passed through the input port and the input waveguide section, distributed by the input antipodal finline array to the active elements, combined again by the output antipodal finlines array, then passed to the output waveguide section and output port. A hermetic sealing scheme, a scheme for improving the power combining efficiency and thermal management scheme are also disclosed. The broadband power combining device operates with multi-octave bandwidth and is easy to manufacture, well-managed thermally, and highly efficient in power combining.

53 Claims, 10 Drawing Sheets

U.S. PATENT DOCUMENTS

| | | | | |
|---|---|---|---|---|
| 4,588,962 | A | 5/1986 | Saito et al. | |
| 4,782,346 | A * | 11/1988 | Sharma | 343/795 |
| 4,925,024 | A | 5/1990 | Ellenberger et al. | |
| 5,057,908 | A | 10/1991 | Weber | |
| 5,142,253 | A | 8/1992 | Mallavarpu | |
| 5,214,394 | A | 5/1993 | Wong | |
| 5,256,988 | A | 10/1993 | Izadian | |
| 5,600,286 | A | 2/1997 | Livingston et al. | |
| 5,736,908 | A | 4/1998 | Alexanian et al. | |
| 5,920,240 | A | 7/1999 | Alexanian et al. | |
| 6,028,483 | A | 2/2000 | Shealy et al. | |
| 6,157,076 | A * | 12/2000 | Azotea et al. | 257/679 |
| 6,384,691 | B1 * | 5/2002 | Sokolov | 331/76 |
| 6,686,875 | B1 * | 2/2004 | Wolfson et al. | 342/175 |

OTHER PUBLICATIONS

Jeong et al, "1.6- and 3.3-W Power-Amplifier Modules at 24 GHz Using Waveguide-Based Power-Combining Structures", IEEE Transactions On Microwave Theory And Techniques, vol. 48, No. 12, Dec. 2000; 0018-9480/00$10.00 © IEEE, pp. 2700-2708.

Ramakrishna Janaswamy et al.; *Analysis of the Tapered Slot Antenna*, IEEE Transactions On Antennas and Propagation, vol. AP-35, No. 9; Sep. 1987; pp. 1058-1065.

Robert A. York et al., *Quasi-Optical Power Combining Using Mutually Synchronized Oscillator Arrays*, IEEE Transactions On Microwave Theory and Techniques; vol. 39, No. 6, Jun. 1991; pp. 1000-1009.

Robert A. York et al., *Coupled-Oscillator Arrays for Millimeter-Wave Power-Combining and Mode-Locking*, IEEE MTT-S Digest, vol. 1; Jun. 1992; pp. 429-432.

R. N. Simmons et al.; *Non-Planar Linearly Tapered Slot Antenna With Balanced Microstrip Feed*; Antennas and Propagation Society Internat'l Symposium, 1992. AP-S. 1992 DIgest. Held in conjuction with: URSI Radio Science Meeting and Nuclear EMP Meeting; IEEE vol. 4; Jul. 1992; pp. 2109-2112.

Rainee N. Simons et al.; *Space Power Amplification With Active Linearly Tapered Slot Antenna Array*; Microwave Symposium Digest1993, IEEE MTT-S Internat'l.; vol. 2; Jun. 1993; pp. 623-626.

Pranay R. Acharya et al.; *Tapered Slotline Antena at 802 GHz*, IEEE Transactions On Microwave Theory and Techniques; vol. 41, No. 10; Oct. 1993; pp. 1715-1719.

P. Liao et al., *A 1 Watt X-Band Power Combining Array Using Coupled VCOs*, IEEE MTT-S Digest, vol. 2; May 1994; pp. 1235-1238.

Nai-Shuo Cheng et al.; *Waveguide-Based Spatial Power Combining*; 1998 National Radio Science Meeting; May 23, 1995; 1 pg.

A. Alexanian et al., *Broadband Spatially Combined Amplifier Array using Tapered Slot Transitions in Waveguide*, IEEE Microwave And Guided Wave Letters, vol. 7, No. 2; Feb. 1997; pp. 42-44.

Angelos Alexanian et al., *Broadband Waveguide-Based Spatial Combiners*, IEEE MTT-S Digest; vol. 3; Jun. 1997; pp. 1139-1142.

Angelos Alexanian; *Planar and Distributed Spatial Power Combiners*; Dissertation, Jun. 1997; 119 pp.

Nai-Shuo Cheng et al.; *20 Watt Spatial Power Combiner In Waveguide*; Microwave Symposium Digest, 1998 IEEE MTT-S Internat'l., vol. 3; Jun. 1998; pp. 1457-1460.

Nai-Shuo Cheng et al.; *Analysis and Design Of Tapered Finline Arrays For Spatial-Power Combining*; Antennas and Propagation Society Internat'l Symposium, 1998 IEEE, vol. 1; Jun. 1998; pp. 466-469.

Kazem F. Sabet et al.; *Fast Simulation Of Large-Scale Planar CircuitsUsing An Object-Oriented Sparse Solver*; Microwave Symposium Digest, 1999 IEEE MTT-S Internat'l., vol. 1; Jun. 1999; pp. 373-376.

Mostafa N. Abdulla et al.; *A Full-Wave System Simulation of a Folded-Slot spatial power combining Amplifier Array*; Microwave Symposium Digest, 1999 IEEE MTT-S Internat'l., vol. 2; Jun. 1999; pp. 559-562.

Nai-Shuo Cheng et al.; *40-W CW Broad-Band Spatial Power Combiner Using Dense Finline Arrays*, IEEE Transactions On Microwave Theory and Techniques, vol. 47, No. 7; Jul. 1999; pp. 1070-1076.

David B. Rutledge et al.; *Failures in Power-Combining Arrays*, IEEE Transactions On Microwave Theory and Techniques, vol. 47, No. 7; Jul. 1999; pp. 1077-1082.

Nai-Shuo Cheng; *Waveguide-Based Spatial Power Combiners*; Dissertation; Aug. 1999; 107 pp.

Nai-Shuo Cheng et al.; *A 120-W X-Band Spatially Combined Solid-State Amplifier*, IEEE Transactions On Microwave Theory and Techniques, vol. 47, No. 12; Dec. 1999; pp. 2557-2561.

Jinho Jeong et al., *A 1.6 W Power Amplifier Module at 24 GHz Using New Waveguide-based Power Combining Structures*, Microwave Symposium Digest; 2000 IEEE MTT-S Internat'l, Jun. 2000; pp. 817-820.

Pengcheng Jia et al.; *Analysis of a Passive Spatial Combiner Using Tapered Slotline Array In Oversized Coaxial Waveguide*; Microwave Symposium Digest, 2000 IEEE MTT-S Internat'l., vol. 3; Jun. 2000; pp. 1933-1936.

Lee-Yin V. Chen et al.; *Development of K-Band Spatial Combiner using Active Array Modules in an Oversized Rectangular Waveguide*; Microwave Symposium Digest, 2000 IEEE MTT-S Internat'l., vol. 2; Jun. 2000; pp. 821-824.

J. Harvey et al.; *Spatial Power Combining for High-Power Transmitters*, microwave, Dec. 2000; pp. 48-59.

Jinho Jeong et al.; *1.6- and 3.3-W Power-Amplifier Modules at 24 GHz Using Waveguide-Based Power-Combining Structures*, IEEE Transactions On Microwave Theory and Techniques, vol. 48, No. 12; Dec. 2000; pp. 2700-2708.

Pengcheng Jia et al.; *Design of Waveguide Finline Arrays for Spatial Power Combining*, IEEE Transactions On Microwave Theory and Techniques, vol. 49, No. 4; Apr. 2001; pp. 609-614.

Pengcheng Jia et al.; *A Compact Coaxial Waveguide Combiner Design For Ultra-Broadband Power Amplifiers*, Microwave Symposium Digest, IEEE MTT-S 2001; vol. 1; May 2001; pp. 43-46.

Robert A. York; *Some Considerations for Optimal Efficiency and Low Noise in Large Power Combiners*, IEEE Transactions On Microwave Theory and Techniques; vol. 49, No. 8; Aug. 2001; pp. 1477-1482.

Lee-Yin V. Chen et al.; *K-band Spatial Combiner using Finline Arrays in Oversized Rectangular Waveguide*, Proceedings of APMC2001, Taipei, Taiwan, R.O.C.; Dec. 2001; pp. 807-810.

Michael P. DeLisio et al.; *Quasi-Optical and Spatial Power Combining*, IEEE Transactions On Microwave Theory and Techniques; vol. 50, No. 3, Mar. 2002; pp. 929-936.

Pengcheng Jia et al.; *Multioctave Spatial Power Combining in Oversized Coaxial Waveguide*, IEEE Transactions On Microwave Theory and Techniques; vol. 50, No. 5, May 2002; pp. 1355-1360.

Pengcheng Jia; *Broadband High Power Amplifiers Using Spatial Power Combing [sic] Technique*; Dissertation; Dec. 2002; 151 pp.

Lee-Yin Chen; *K-Band Spatial Combiner using Active Array Modules in an Oversized Rectangular Waveguide*; Dissertation; Jun. 2003; 118 pp.

Pengcheng Jia et al.; *6 to 17 GHz Broadband High Power Amplifier Using Spatial Power Combining Technique*, Microwave Symposum Digest, 2003 IEEE MTT-S Internat'l .; vol. 3; Jun. 2003; pp. 1871-1874.

Pengcheng Jia et al.; *Broad-Band High-Power Amplifier Using Spatial Power-Combining Technique*, IEEE Transactions On Microwave Theory and Techniques; vol. 51, No. 12; Dec. 2003; pp. 2469-2475.

Ville S. Möttönen; *Wideband Coplanar Waveguide-to-Rectangular Waveguide Transition Using Fin-Line Taper*, IEEE Microwave and Wireless Components Letters, vol. 15, No. 2; Feb. 2005; pp. 119-121.

Pengcheng Jia; *A 2 to GHz high Power amplifier Using Spatial Power Combining Techniques*, reprinted with permission from Microwave Journal; Apr. 2005; 4 pp.

* cited by examiner

Left Side Cross-Section

Middle Cross-Section

Right End Cross-Section

BROADBAND POWER COMBINING DEVICE USING ANTIPODAL FINLINE STRUCTURE

BACKGROUND OF THE INVENTION

1. Field of the Invention

The invention relates to a device for spatially dividing and combining power of an EM wave using a plurality of longitudinally parallel trays. More particularly, the invention relates to a device for dividing and combining the EM wave by antipodal finline arrays provided within a coaxial waveguide cavity.

2. Description of the Related Art

The traveling wave tube amplifier (TWTA) has become a key element in broadband microwave power amplification for radar and satellite communication. One advantage of the TWTA is the very high output power it provides. However, several drawbacks are associated with TWTAs, including short life-time, poor linearity, high cost, large size and weight, and the requirement of a high voltage drive, imposing high voltage risks.

Solid state amplifiers are superior to TWTAs in several aspects, such as cost, size, life-time and linearity. However, currently, the best available broadband solid state amplifiers can only offer output power in a watt range covering about 2 to 20 GHz frequency band. A high power solid state amplifier can be realized using power combining techniques. A typical corporate combining technique can lead to very high combining loss when integrating a large amount of amplifiers. Spatial power combining techniques are implemented with the goal of combining a large quantity of solid-state amplifiers efficiently and improving the output power level so as be competitive with TWTAs.

U.S. Pat. No. 5,736,908, issued to Alexanian et al., discloses a power combining device using a slotline array within rectangular waveguides. In an embodiment shown in FIG. 7 of that patent, a circular waveguide is shown, but the slotline array is arranged with elements that are disposed in parallel within the waveguide.

In N. S. Cheng, Pengcheng Jia, D. B. Rensch and R. A. York, "A 120-Watt X-Band Spatially Combined Solid-State Amplifier", IEEE Trans. Microwave Theory and Tech., vol. 47, (no. 12), IEEE, December 1999. p. 2557–61, a working active combiner unit using a slotline array inside an X band rectangular waveguide is disclosed. The bandwidth of the combiners is limited by the bandwidth of the rectangular waveguide, which has an fmax:fmin (maximum operational frequency over minimum operational frequency ratio) of less than 2. Since the dominant mode inside the rectangular waveguide is TE10 mode, the combiners also have a dispersion problem over the whole waveguide band.

In another reference, Jinho Jeong, Youngwoo Kwon, Sunyoung Lee, Changyul Cheon, Sovero EA. "A 1.6 W Power Amplifier Module At 24 Ghz Using New Waveguide-Based Power Combining Structures," 2000 IEEE MTT-S International Microwave Symposium Digest (Cat. No.00CH37017), IEEE, Part vol. 2, 2000, pp. 817–20 vol. 2. Piscataway, N.J., USA, there is proposed an antipodal finline structure with double antipodal finlines inside a rectangular waveguide. The antipodal finline provides no-bond-wire transition from waveguide finline to microstrip line. It simplifies the connection with commercial off-the-shelf (COTS) microwave monolithic integrated circuits (MMIC) which predominantly use microstrip lines. However, as in U.S. Pat. No. 5,736,908 and other prior art, the bandwidth of the system is limited by the rectangular waveguide used.

U.S. Pat. No. 5,920,240, issued to Alexanian et al., discloses a coaxial waveguide power combiner/splitter, which inserts slotline cards into the coaxial waveguide for power distribution and combining. In the combiner/splitter, power devices are mounted on the slotline cards and then slid into the waveguide. This arrangement suffers from serious heat dissipation issues, as it is difficult to remove heat effectively from the power devices to an outside heat sink since the heat spreads to the slotline card first, then conducts to the waveguide through the sliding contacts between the slotline card and the waveguide. Because the combiner is mainly used for high power amplifier design and active devices are mostly high power amplifiers, the amount of heat generated is considerably high. The heat increases the operation temperature and decreases the lifetime of the amplifiers dramatically. Moreover, it is difficult to connect outside DC bias into the active devices on the slotline cards, and to access the slotline cards generally, as these are disposed inside an enclosed waveguide structure.

Two other references (Pengcheng Jia, R. A. York, "Multi-Octave Spatial Power Combining in Oversized Coaxial Waveguide", IEEE Trans. Microwave Theory and Tech, vol. 50, (no. 5), IEEE, May 2002. p. 1355–60) and (Pengcheng Jia, Lee-Yin Chen, Alexanian A, York R A. "Broad-Band High-Power Amplifier Using Spatial Power-Combining Technique." IEEE Transactions on Microwave Theory & Techniques, vol. 51, no. 12, December 2003, pp. 2469–75. Publisher: IEEE, USA) propose a stacked tray approach for power combining inside a coaxial waveguide. A plurality of identical wedge-shaped trays are stacked to form a coaxial waveguide, providing DC paths in the middle of the tray. In the first reference, active devices are mounted on the slotline card and directly connected to the end of the slotlines. Even though a metal tray is added underneath the slotline card, the thermal resistance caused by many layers of material and junctions remains problematic when high power devices are used. Since bonding wires are used to connect from slotline to MMIC which is not on the same layer, the parasitic effect will deteriorate the performance at higher frequency band. Further, assembly complications and costs are high.

In the second reference, an improved design enables easy assembly with COTS MMICs by integrating slotline to microstrip baluns to the end of slotlines. This provides improved thermal management since the active devices are directly mounted on to the metal wedge shaped trays. However, the balun has a slotline stub at the end of the narrow slotline on the backside of the substrate and a microstrip line stub on the top side of the substrate. The centers of the two stubs require alignment on the same axis perpendicular to the surface of the substrate. The accurate back side-to-top side alignment requirement significantly complicates the manufacturing process. The balun also takes considerable surface area. The size of the balun depends on the lower cutoff frequency of the system. The lower the cutoff frequency, the bigger the balun is. Since the surface area on the slotline circuit is limited, the maximum operational frequency range demonstrated by an arrangement of this second reference is only from 6 to 18 GHz, a 3:1 $f_{max}:f_{min}$ ratio.

The slotline card design without slotline to microstrip balun disclosed in U.S. Pat. No. 5,920,240, shows a broader bandwidth ratio. However, if the end of the slotline is mounted on metal trays, then its dominant mode is TE mode, a non-TEM mode and dispersive over broad bandwidth. To achieve broad bandwidth response, the slotline needs to match with standard MMIC input/output impedance, 50 Ohm. Since the slotline tends to have high characteristic impedance, the gap of the slotline will be as narrow as 1 to 2 mil. The slotline cards thus require high accuracy photolithography instead of the conventional PCB (printed circuit board) processes which can normally achieve a best gap width of 4 to 6 mil. For this reason, the slotline cards used in real systems shown in the above-cited references are all built on ceramics with highly accurate lithography. This increases costs dramatically, and since the ceramics are fragile, it raises significant reliability issues.

BRIEF SUMMARY OF THE INVENTION

In accordance with the invention, a broadband power combining device uses antipodal finline arrays disposed inside a coaxial waveguide to spatially divide and combine a TEM (transverse electromagnetic) wave. The antipodal finline structures, each of which is part of a wedge shaped tray, are transformed into an array inside the waveguide by stacking the wedge shaped tray to form a coaxial waveguide.

The device includes an input port, an input waveguide section, a center waveguide section formed by stacked wedge shaped trays, an output waveguide section, and an output port. Each tray comprises a wedge shaped metal carrier, an input antipodal finline structure, one or more active elements, an output antipodal finline structure and necessary biasing circuitry. The wedge shaped metal carriers have a predetermined wedge angle and predetermined cut-out regions. The inside/outside surfaces of the metal carrier and surfaces of the cut-out regions all preferably have cylindrical curvatures. When the trays are stacked together, a cylinder is formed with a coaxial waveguide opening inside. The antipodal finline structures form input and output arrays. An incident wave is passed through the input port and the first waveguide section, distributed by the input antipodal finline array to the active elements, combined again by the output antipodal finline array, then passed to the output waveguide section and output port.

The broadband power combining device spatially divides and combines waves. It has the high combining efficiency when combining a large quantity of active elements.

The wedge shaped carriers in the device provide a DC bias path and good thermal management. Slots or holes are machined in the middle of the metal carrier for DC lines. When the trays are stacked together, DC bias lines will be connected to inside active elements through those slots or holes. Active elements are eutectically attached to the center of the metal carrier. It will minimize the thermal resistance from active element to the outside heat sink.

The antipodal finline is disposed on a soft board substrate material and can be manufactured by a conventional PCB process. The antipodal finline has a tapered conductor on the top side of the substrate and a tapered conductor on the back side. The top side conductor tapers to about half of the board width, then tapers to a narrow strip, which becomes a microstrip line. The back side conductor tapers to about half of the board width, then tapers to the full board width which will become the ground for the top side microstrip line. Since the tolerance for back side to top side alignment is not tight and all the dimensions are large enough, it is much easier to manufacture as compared with circuits using a slotline to microstrip balun and still offers good compatibility with COTS MMIC's.

The antipodal finline tapers disposed inside a coaxial waveguide can achieve broadband frequency response since the waveguide system is a Quasi transverse Electromagnetic (TEM) structure. The dominant mode propagating inside the coaxial waveguide is TEM mode, which means the electromagnetic (EM) field is perpendicular to the propagation direction. The antipodal finline disposed inside the coaxial waveguide has electric field points from one conductor to the other conductor. Its magnetic field is in the tangent direction on the cross section plane and perpendicular to both the electric field and propagation direction. The antipodal finline inside coaxial waveguide is a balanced transmission line. When the antipodal finline tapers down and begins to overlap, either side can be selected to become the microstrip line. When the balance waveguide finline tapers to an unbalanced planar microstrip line, which is a quasi-TEM transmission line, the EM field is still transverse. The whole antipodal finline structure is a Quasi-TEM structure and has very small dispersion over broad bandwidth.

By using antipodal finlines, the invention achieves the broadest bandwidth that has ever been practically achieved by a spatial power combiner. Moreover, the antipodal finline design makes it possible to fabricate the circuit with a PCB process. It simplifies the assembly process and dramatically reduces the cost for manufacturing.

In the aforementioned prior art, MMICs (monolithic microwave integrated circuits) in the bare die form are used. However, many military applications require hermetic sealing. It is difficult to seal the whole waveguide structure since many wedge trays are stacked together with many mechanical connections. Heretofore, there has been no solution yet addressing the hermetic seal problem for spatial waveguide combiners using stacked trays, not only in coaxial waveguide combiners, but also in rectangular waveguide combiners.

In the presently claimed invention, individually packaged MMICs are used in the combining device. The packages are hermetically sealed. Since all the other elements are passive, the whole structure is considered hermetically sealed. This will significantly reduce the complexity of the system and make it accessible for easy repair.

The packages of the invention are also surface mountable and have a metal base which is soldered to the metal tray. RF input/output ports are soldered to the microstrip line of the antipodal finline structure. The soldering connections will minimize both thermal resistance from chip to carrier and RF parasitic noise.

In another aspect of the invention, there is provided an innovative biasing scheme to maximize the combining efficiency for spatial waveguide power combining devices. Since MMIC's are used as active elements, the maximum combining efficiency will be achieved when all the MMIC's have uniform performance. Loss can be caused by amplitude and phase variation among the elements. The current semiconductor integrated circuits still have considerable variations from die to die. In most of the amplifier MMIC's, the semiconductor devices are GaAs HEMTs (high electron mobility transistor) which use gate voltage to control the output current. To insure each element is putting out the same amount of power, a feedback circuit is used to sense the drain current and lock it to a fixed value by adjusting gate voltage. Since the load for each active element is the same, for a fixed drain current, the output power will be the same too. This scheme helps to improve the power combining efficiency for spatial waveguide power combining devices.

Further in accordance with the invention, there is disclosed a novel thermal management scheme for spatial waveguide power combining devices. A heat sink is machined with a cylindrical cavity. The heat sink further operates as a clamp, holding the center trays tightly and providing good thermal and mechanical contact therewith, thereby conducting heat effectively away from the trays to the fins of the heat sink for dissipation from the device.

BRIEF DESCRIPTION OF THE SEVERAL VIEWS OF THE DRAWINGS

Many advantages of the present invention will be apparent to those skilled in the art with a reading of this specification in conjunction with the attached drawings, wherein like reference numerals are applied to like elements, and wherein.

DETAILED DESCRIPTION OF THE INVENTION

In accordance with the invention, a broadband spatial power combining device using longitudinally parallel, stacked wedge shaped trays is provided. Antipodal finline structures are mounted on each tray. When the trays are stacked together to form a coaxial waveguide, the antipodal finline structures are disposed into the waveguide and form a dividing array at the input and a combining array at the output. With the use of antipodal finline arrays inside the coaxial waveguide for power dividing and combining, a broadband frequency response covering the range of about 2 to 20 GHz is realized. The antipodal finline structure is easy to manufacture using conventional printed circuit board (PCB) processes. It also enables easy integration with COTS (commercial off-the-shelf) MMICs. Further, the division of a coaxial waveguide into wedge-shaped trays enables simplified DC biasing and provides good thermal management.

Figure 1:
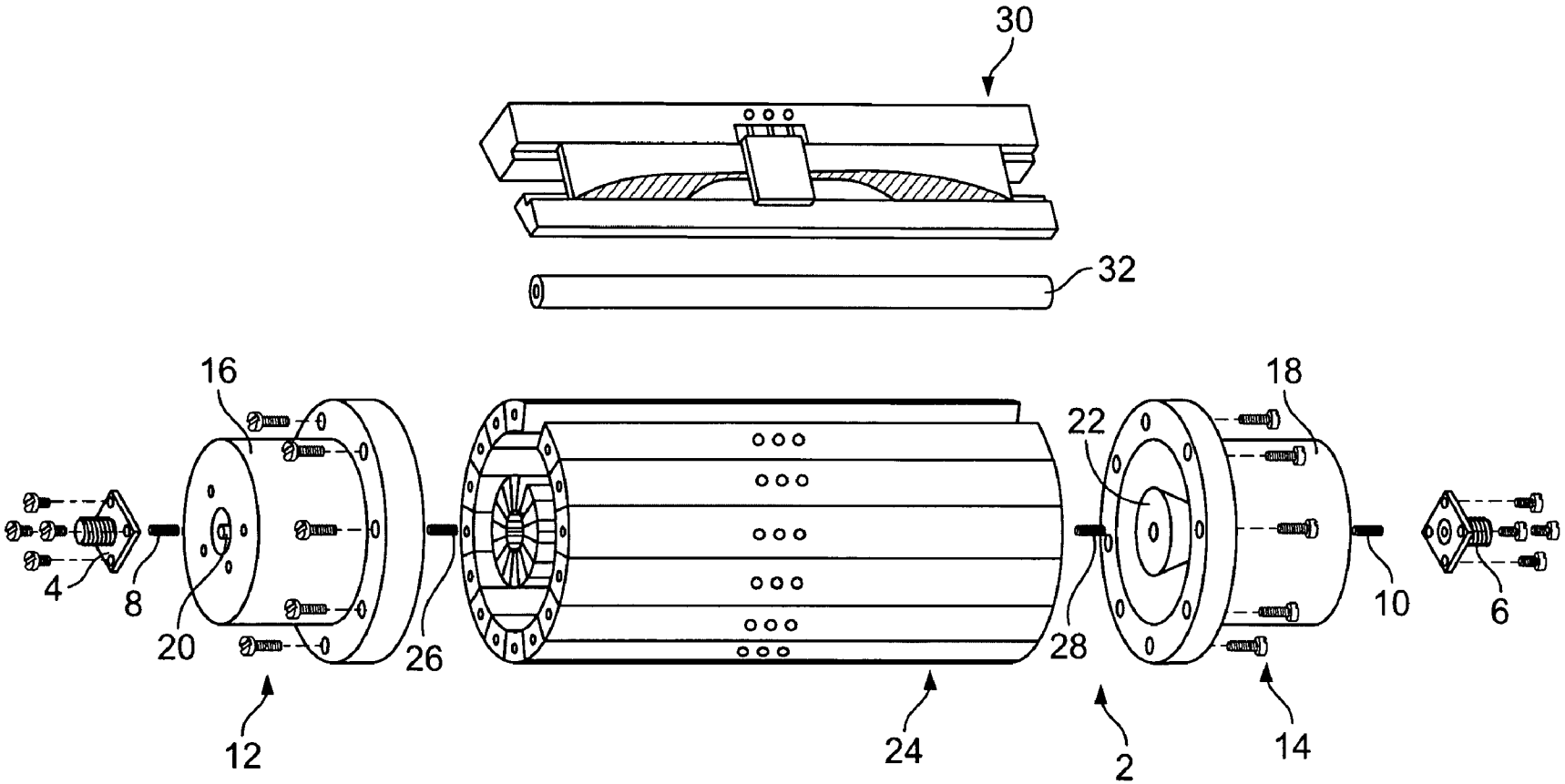
FIG. 1 is a perspective view of the power combining system in accordance with the invention.

As illustrated in FIG. 1, in the spatial power combining device 2 of the invention, an EM (electromagnetic) wave is launched from an input port 4 to an input coaxial waveguide section 12, then the EM wave is collected through an output coaxial waveguide section 14 to an output port 6. The input/output waveguide sections 12 and 14 provide broadband transitions from the input/output ports 4 and 6 to a center waveguide section 24. The outer surfaces of inner conductors 20 and 22 and the inner surfaces of outer conductors 16 and 18 all have gradually changed profiles. The profiles are determined to minimize the impedance mismatch from the input/output ports 4 and 6 to the center waveguide section 24.

In the preferred embodiment, the input/output ports 4 and 6 are field replaceable SMA (Subminiature A) connectors. The flanges of the input/output port 4 and 6 are screwed to the outer conductors 16 and 18 with four screws each, although that number is not crucial, and other types of fasteners may be used. Pins 8 and 10 are used to connect between centers of the input/output port 4 and 6 and inner conductors 20 and 22. In other embodiments, the input/output ports may be super SMA connectors, type N connectors, K connectors or any other suitable connectors. The pins 8 and 10 can also be omitted, if the input/output ports already have center pins that can be mounted into inner conductors 20 and 22.

The center waveguide section 24 comprises a plurality of trays 30 and a cylinder post 32 whose major longitudinal axis is coincident with a central longitudinal axis of the center waveguide section. The plurality of trays 30 are stacked circumferentially around the post 32. Each tray 30 includes a carrier 54 (FIG. 2) having a predetermined wedge angle $\alpha$ (FIG. 3), an arcuate inner surface 36 conforming to the outer shape of post 32, and arcuate outer surface 34. When the trays 30 are assembled together, they form a cylinder with a cylindrical central cavity defined by inner surfaces 36 which accommodates the post 32. Post 32 connects with inner conductors 20 and 22 of input/output waveguide sections 12 and 14 by way of screws 26 and 28 on opposite ends of the post. Post 32 is provided for simplifying mechanical connections, and may have other than a cylindrical shape, or be omitted altogether.

Figure 2:
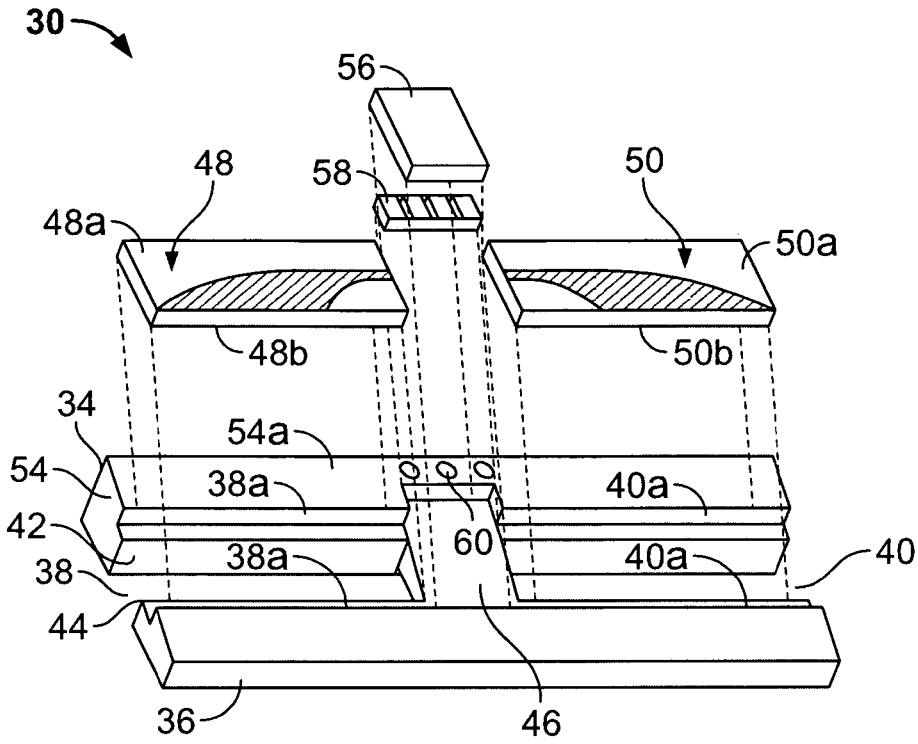
FIG. 2 is perspective view of a wedge shaped tray.

As detailed in FIG. 2, each tray 30 also includes an input antipodal finline structure 48, at least one active element 56, an output antipodal finline structure 50, and attendant DC circuitry 58. The metal carrier 54 has an input cut-out region 38 and an output cut-out region 40. The input and output cut-out regions are separated by a bridge 46. Opposing major surfaces 42 and 44 of the regions 38 and 40 are arcuate in shape. When the trays 30 are stacked together, the regions 38 and 40 form a coaxial waveguide opening defined by circular outer and inner surfaces corresponding to arcuate major surfaces 42 and 44, and the arrangement of the input and output finline structures on carriers 54 is such that the finline structures lie radially about the central longitudinal axis of center waveguide section 24. Alternatively, major surfaces 42 and 44 can be planar, rather than arcuate, such that the coaxial waveguide opening, in cross-section, will be defined by polygonal outer and inner boundaries corresponding to planar major surfaces 42 and 44.

The top surface 54*a* of metal carrier 54 is provided with recessed edges 38*a* and 40*a* in the periphery of cut-out regions 38 and 40, and is recessed at bridge 46, in order to accommodate the edges of antipodal finline structures 48, 50, active elements 56 and DC circuitry 58. When in position in a first carrier 54, the back edges of antipodal finline structures 48, 50 rest in the corresponding recessed edges 38*a*, 40*a* of the carrier 54, and back faces 48*b* and 50*b* of the finline structures respectively face cut-out regions 38, 40 of that first tray. Contact between the back faces 48*b* and 50*b* of antipodal finline structures 48, 50 and the corresponding recessed edges 38*a*, 40*a* of the carrier 54 provides grounding to the finline structures.

Figure 4:
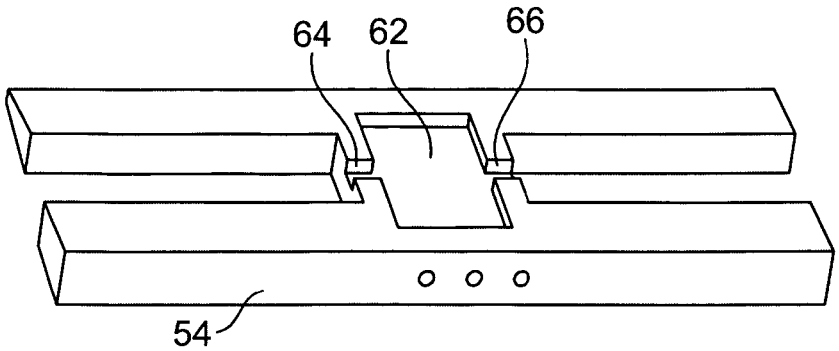
FIG. 4 is back side view of the wedge shaped metal carrier.

The back side of each carrier 54 has a cavity 62 as shown in FIG. 4, such that when the trays are stacked together, the cavity 62 will provide enough space to accommodate the active elements on the abutting tray and carrier. In the preferred embodiment, the cavity 62 is provided with channels 64 and 66 to avoid electrical contact with the microstrip lines of the finline structures of the abutting tray and carrier.

Figure 3:
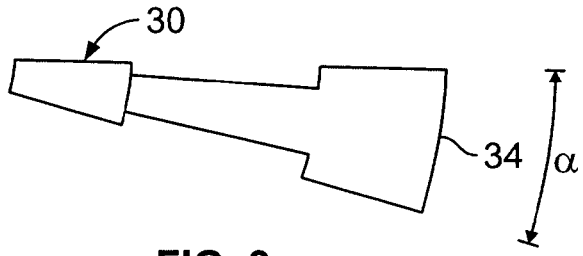
FIG. 3 is the cross section of the wedge shaped metal carrier.

FIG. 3 shows a cross section at the middle of a carrier 54. Outer surface 34 of the carrier is arcuate in shape such that when assembled together, the trays provide the center coaxial waveguide section 24 with a substantially circular cross-sectional shape. It is contemplated that other outer surface shapes, such as planar shapes, can be used, in which case the outer cross-sectional shape of the center coaxial waveguide section 24 becomes polygonal (see FIG. 4A). Further, as mentioned above, the carrier has a predetermined wedge angle $\alpha$. Preferably, 16 trays are used, with the wedge angle $\alpha$ being 22.5°.

Figure 4A:
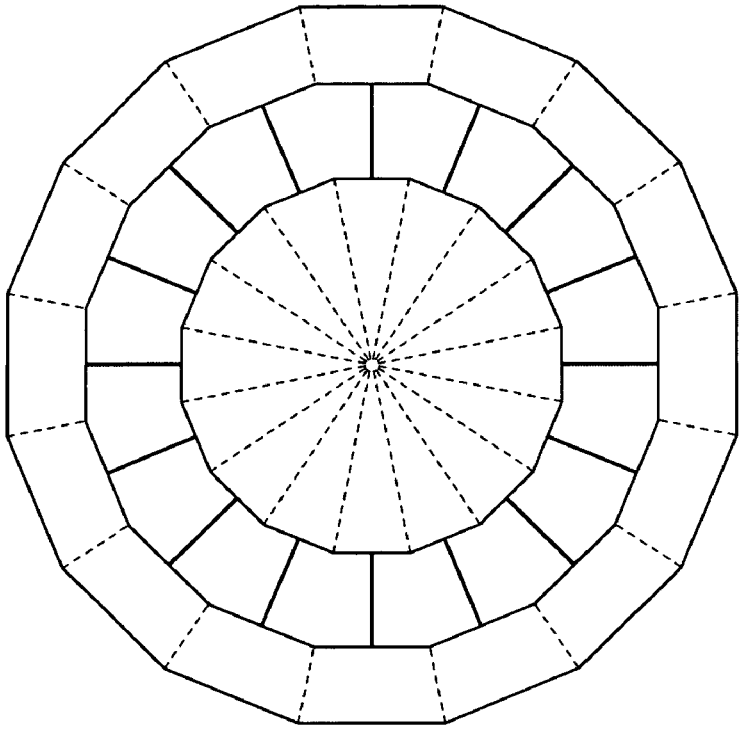
FIG. 4A is the cross section of center waveguide structure which has a plurality of planar surfaces.

While it is preferred that the outside surfaces 34, 36 of each carrier 54, along with the inside surfaces 42, 44 of the cut-out regions all be arcuate in shape so as to provide for circular cross-sections, it is possible to use straight edges for some or all of these surfaces, or even other shapes instead, with the assembled product thereby approximating cylindrical shapes depending on how many trays 30 are used. FIG. 4A shows an embodiment in which a cross section of the center waveguide shows that the outside surfaces and inside coaxial waveguide openings are all approximated by straight planes. A polygonal cross-sectional shape results, but if a sufficient number of trays are used, a circular cross section is approximated.

Figure 4B:
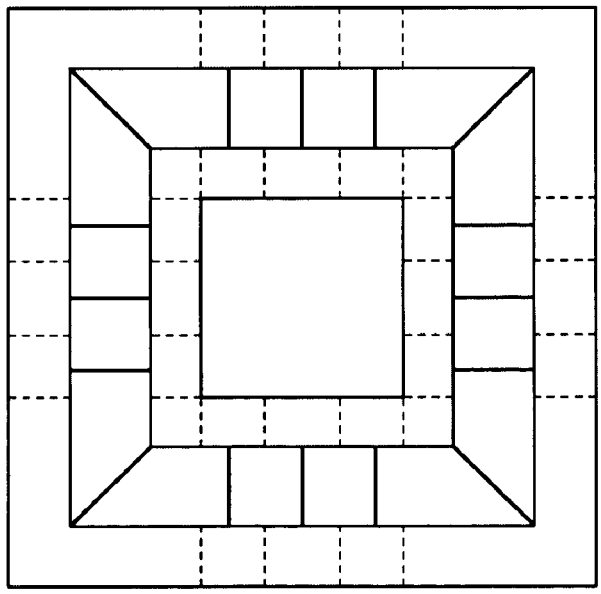
FIG. 4B is the cross section of center waveguide structure which has a rectangular outside profile and a rectangular coaxial waveguide opening.

In the preferred embodiment, the wedge shaped trays 30 are radially oriented when stacked together to form a circular coaxial waveguide, as seen schematically in FIG. 4A. However, the trays can have other shapes, which may be different from one another, and a non-cylindrical coaxial waveguide can thus result. FIG. 4B shows such an arrangement, resulting in a rectangular (square) coaxial waveguide. In FIGS. 4A and 4B, the bold solid lines represent the finline structures. The dashed lines represent the inter-tray boundaries.

Returning to FIG. 2, it can be seen that at least one active element 56 is disposed on bridge 46, between the antipodal finline structures 48 and 50. DC bias circuitry 58 is also disposed on the tray. Holes 60 are provided for the DC bias connection (not shown) to circuitry 58, which then passes to active element 56 as described below. In the preferred embodiment, input/output antipodal finline structure 48, 50 and DC bias circuitry 58 are disposed on separate boards. Alternatively, they may be disposed on the same board.

When the trays 30 are stacked together, the cut-out regions 38, 40 cumulatively form a coaxial waveguide opening. The antipodal finline structures 48, 50 form input and output antenna arrays in the coaxial waveguide opening. The input array couples the incoming signal, which enters from the input port 4 through input waveguide section 12, from the stacked tray-formed waveguide opening, distributing the energy substantially evenly to each tray 30, and passing it to the active elements for processing. Then the processed signal is combined by the output antipodal finline array inside the output coaxial waveguide opening, and propagated through the output waveguide section 14 to the output port 6.

Figure 5A:
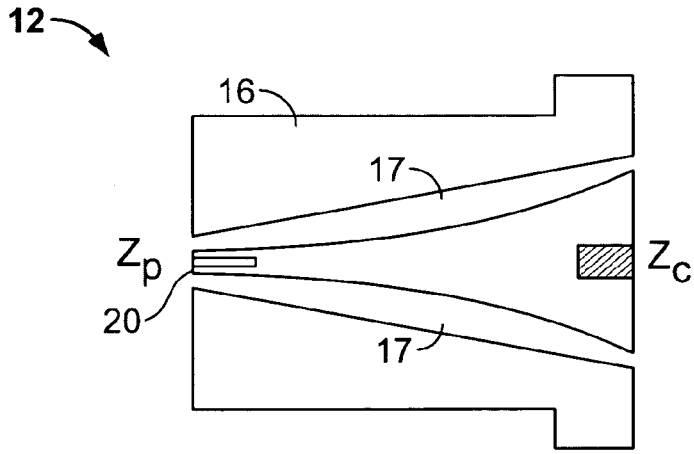
FIGS. 5A and 5B are longitudinal cross sections of the input/output waveguide section.
Figure 5B:
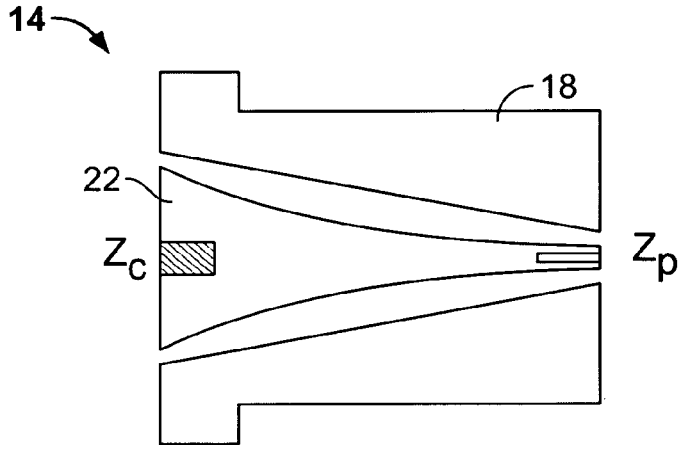

FIGS. 5A and 5B shows a longitudinal cross-sectional view of the output coaxial waveguide section 14. The waveguide section provides a smooth mechanical transition from a smaller input/output port (at Zp) to a flared center section 17. Electrically, the waveguide section provides broadband impedance matching from the input/output port impedance Zp to the center section waveguide impedance Zc. The profiles of the inner conductors and outer conductors are determined by both optimum mechanical and electrical transition in a known fashion.

Figure 6:
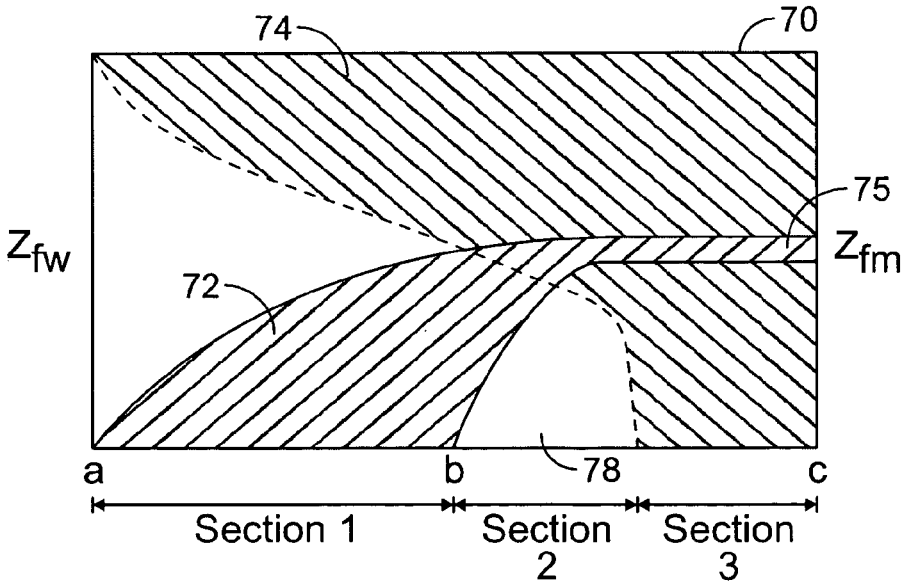
FIG. 6 is a schematic view of an antipodal finline structure.
Figure 7A:
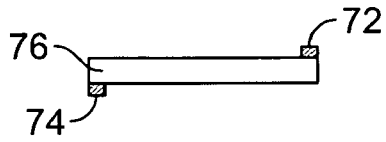
FIG. 7 is a schematic view of the cross sections of the antipodal finline structure.
Figure 7B:
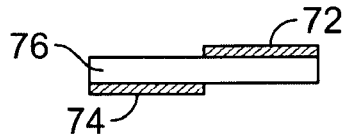
Figure 7C:
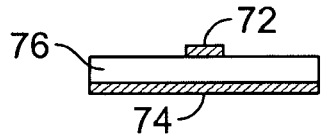

With reference to FIGS. 6 and 7, details of the antipodal finline structure 70 of the invention are disclosed. Three sections (Sections 1, 2, and 3, demarcated by lines a, b, and c), are delineated in the drawing figures for ease of explanation and discussed separately, with the understanding that these sections are not separate but are actually part of one unitary component. In Section 1, lying between lines a and b, top side (corresponding to side 48*a* of FIG. 2) metal conductor 72 and back side metal conductor 74 (corresponding to side 48*b* of FIG. 2) are shown to expand in area outward respectively from the lower and upper edges of the substrate 76. In Section 2 (between lines b and c) top side conductor 72 narrows to a strip 75, while back side conductor 74 expands to a wider ground that has the same width as the substrate. Section 3 has a straight microstrip line on the top side, and a back side conductor as ground. This arrangement is easier to manufacture by eliminating a conventional balun as is know in the prior art, while still offering good compatibility with COTS MMICs. The tapered 3-section antipodal finline is referred to herein as an antipodal finline taper. In the preferred embodiment, the overall length of an antipodal finline taper is about 2.4 inches.

FIG. 7 shows the cross sections of the antipodal finline taper taken along lines a, b and c. The top side conductor 72 and back side conductor 74 are preferably disposed on a soft PTFE based substrate 76. The substrate can also be any other suitable material, such as ceramic, or non-PTFE substrate. The cross sections of FIG. 7 show the gradual changes of the top and back side metal conductors from left side to the right side. The top side conductor 72 becomes wider first and then narrower as a microstrip line. The back side conductor 74 becomes wider, then a ground plane.

The described antipodal finline structures provide broadband transitions from a waveguide impedance Zfw to a microstrip impedance Zfm. The Section 1 of the antipodal finline is determined for minimizing the reflection between Zfw and Zfm. Small reflection theory is used to synthesize the profile of the taper shape. The Section 2 in the antipodal finline transits the balanced finline to an unbalanced microstrip line. The top side connector 72 is tapered to the center of the structure, away from the waveguide wall. The back side conductor 74 is extended to the other side of the waveguide wall to form a full ground plane. At the overlapping area, a cavity area 78 in the substrate is formed. The length of Section 2 must be judiciously chosen, with the caveats that if the section is too long, the cavity will excite resonance at higher frequency, while if it too short, then the shortened distance from the center microstrip to the waveguide wall will deteriorate the lower frequency response.

Figure 6A:
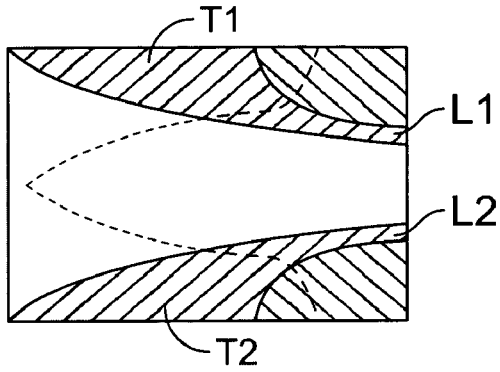
FIG. 6A is a schematic view of an antipodal finline structure with double finline tapers.
Figure 6B:
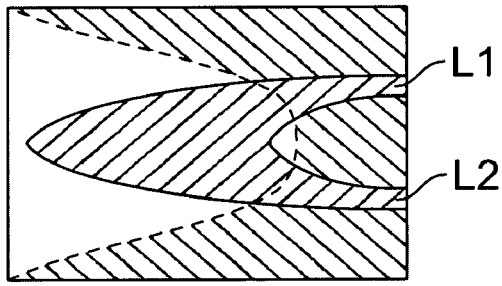
FIG. 6B is a schematic view of another antipodal finline structure with double finline tapers.
Figure 6C:
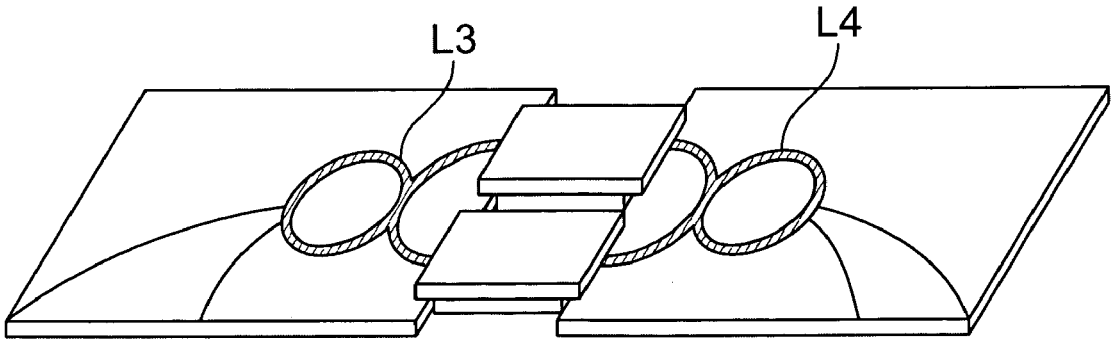
FIG. 6C is a schematic perspective view of a pair of antipodal finline structures in which each antipodal finline taper is connected to more than one active element by a multi-way planar divider and combiner.

As described above, a single antipodal finline taper is included in each antipodal finline structure. The input taper connects to one active element, which then connects to one output taper. However, more antipodal finline tapers can be added in each antipodal finline structure and more active elements can be added as well. Examples of such arrangements can be seen in FIGS. 6A and 6B, wherein arrangements for more than one antipodal finline taper, disposed parallel to each other are shown. Each input antipodal finline taper in these arrangements connects to a single active element (not show), to which an output antipodal finline taper is then connected. In FIG. 6A, the top side conductors T1 and T2 are shown to taper from the edge of the waveguide to the microstrip lines L1 and L2; in FIG. 6B, they taper from the center to the microstrip lines. It is also contemplated that at least one antipodal finline taper is included in each finline structure, but with each antipodal finline taper being connected to more than one active element by a multi-way planar divider and combiner. One example is shown in FIG. 6C. L3 and L4 are 2-way planar divider/combiners. 2 active elements can be further combined by the divider and combiner. Multi-way divider/combiners with more than 2 channels can also be used for combining more active elements to each finline taper.

Figure 12:
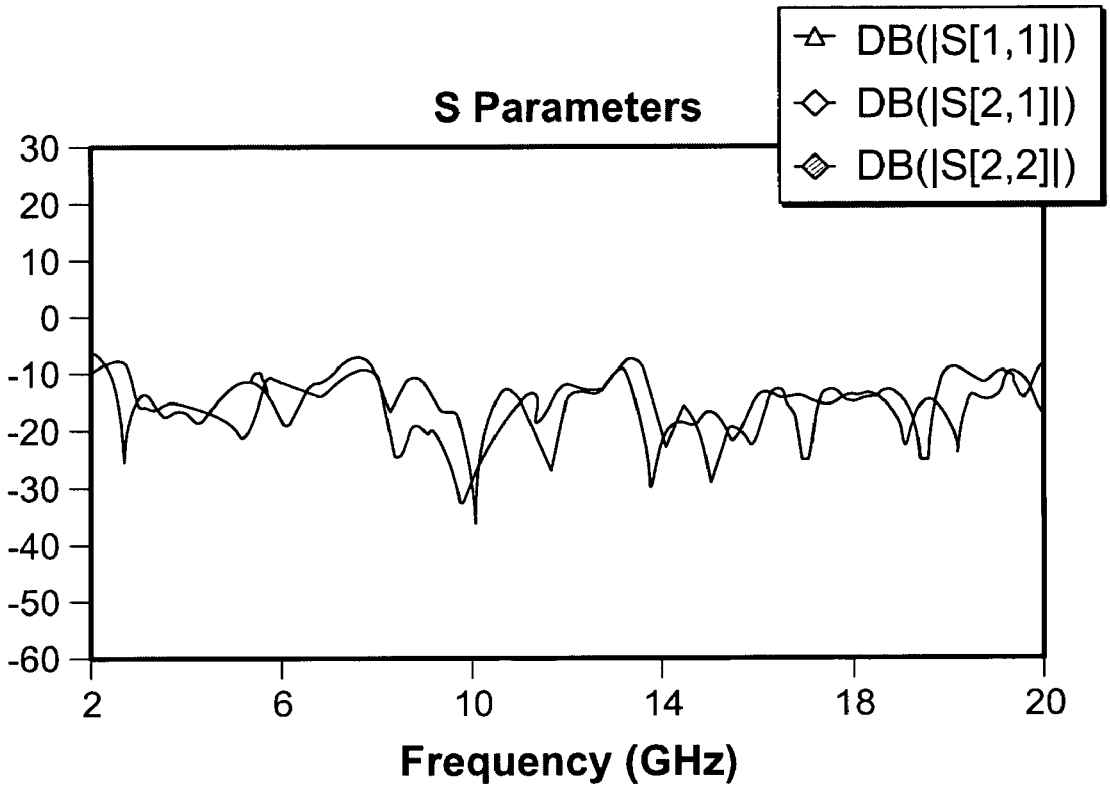
FIG. 12 is a diagram of the s parameters of a broadband power combining device using antipodal finline structures.

FIG. 12 shows the frequency response of the broadband power combining device using antipodal finline structures of the invention. It can be seen that a broadband frequency response from 2 to 20 GHz is achieved. Broadband amplifiers are used as active elements. Hence, a 14 dB gain across the band was observed.

Figure 8:
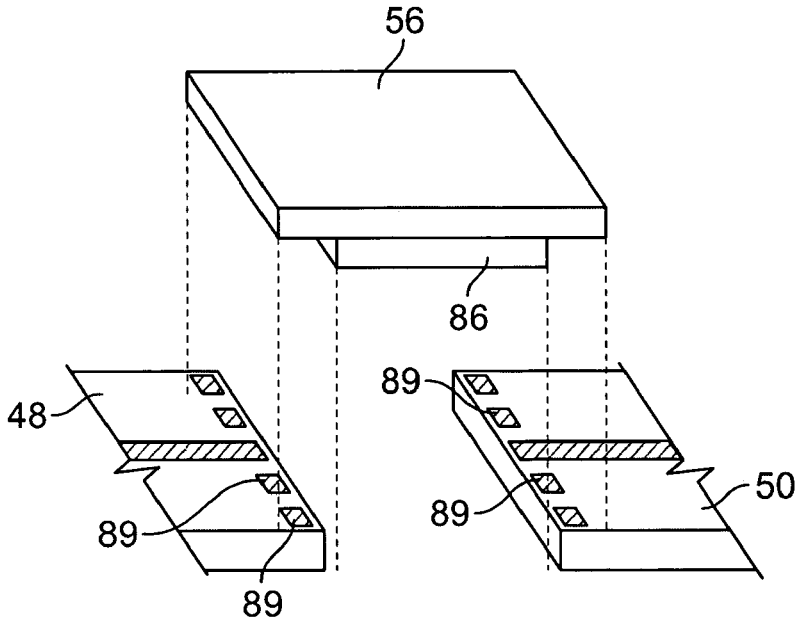
FIG. 8 is an assembly diagram of an active element.
Figure 8A:
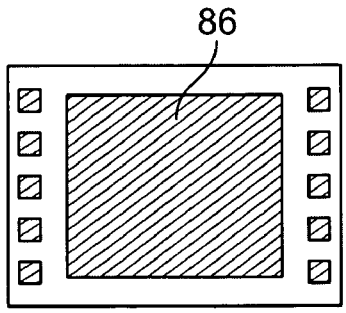
FIG. 8A is a back side view of the active element of FIG. 8.

FIG. 8 shows details of a packaged form, surface-mountable active element 56 assembled between the input/output antipodal finline structures 48 and 50. Alternatively, a bare die form active element can be used, although in most circumstances a packaged form active element is preferred. A hermetically sealed packaged active element more easily meets more stringent hermiticity requirements, for example for military applications, since it is more difficult to hermetically seal the whole system. Both surface-mountable or leaded packages can be used in the system. However, a surface-mountable package is preferred for less parasitic effects at higher frequencies. Active elements typically require good thermal management, and packages with good heat dissipation are desirable. As seen in FIG. 8, a highly thermal conductive base 86 is included in the package. The base 86 is directly mounted on the wedge-shaped metal tray 30. The backside of the package, detailing pad layout, is shown in FIG. 8A. Pads 89 matching the package pad layout are disposed on the input/output finline structure 48 and 50 and make electrical contact therewith at assembly. As will be appreciated, use of a hermetically sealed active element package is not limited to an antipodal finline structure, but includes any type of antenna structure, such as a slotline structure. Further, the hermetically sealed active element package can be used with antennas used in a coaxial or rectangular type waveguide combiner.

Figure 9:
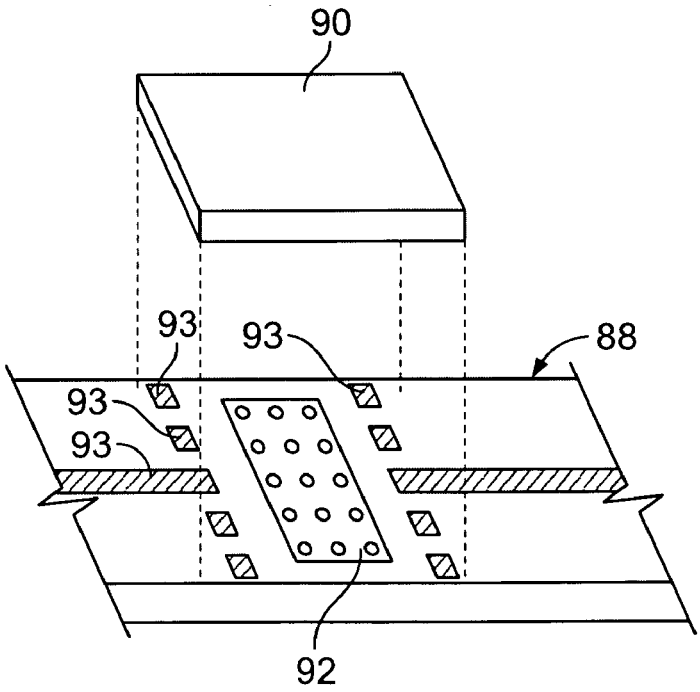
FIG. 9 is the assembly diagram with another active element which is in a flat surface mount package.
Figure 9A:
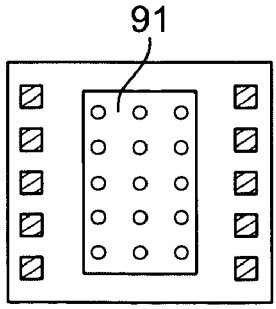
FIG. 9A is a back side view of the active element of FIG. 9.

In another embodiment illustrated in FIG. 9, a surface mount package 90 is directly mounted on a board 88 which also includes an input/output finline structures, all arranged as one unitary component. The back side view of package 90 is shown in FIG. 9A. A center ground area 91 is disposed on the package for both RF grounding and heat dissipation. A via-filled area 92 is provided on the board 88. The via holes provide good heat dissipation for the active elements of package 90. Pads 93 provided on board 88 are for RF, DC and ground connections matching the pad layout of package 90.

Figure 10:
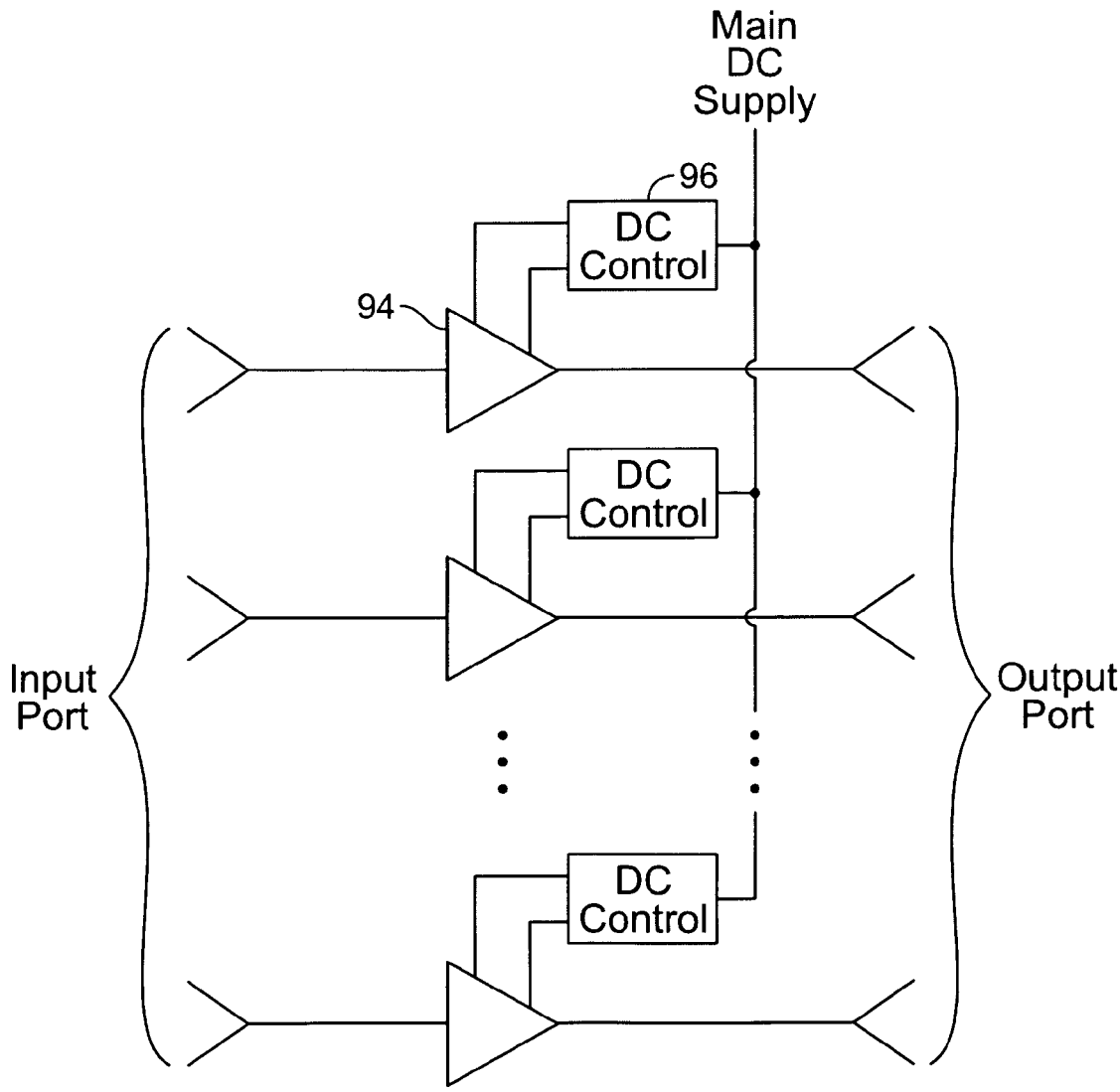
FIG. 10 is schematic diagram of a DC controlling circuit used to achieve unified output power from each active element in accordance with the invention.

FIG. 10 shows a schematic diagram of a spatial power combining device. Element 94 is an exemplary active element in the system. In power combining applications, maximum power combining efficiency is achieved when the active elements all output the same amount of power at the same phase. However, variations are inevitable for semiconductor devices used in the active elements. A DC control circuit 96 is therefore added to each active element to equalize the output power from each element. In the preferred embodiment, a field effect transistor (FET) (not shown) is used as an active element. A feedback network from drain current to gate voltage is used as a DC control circuit. The drain current is used to determine the maximum output power capacity from each active element. The feedback circuit is used to adjust the gate voltage to maintain a fixed drain current, and hence a fixed output power. The AM to PM distortion will thus be similar for each element, and the phase difference can also be minimized. In another embodiment, a power sensor is added at the output of active elements. A feedback circuit is provided from the output of the power sensor to the gate voltage. By sensing the output power, the feedback circuit will lock it to a fixed value. Then the combining efficiency can be maximized.

It will be appreciated that the active elements are not limited to FETs. They can be bipolar transistors (BJT) or HBTs (Heterjuntion BJTs). Further, the feedback DC control circuit is not limited to gate voltage controlling. It can control the base current, drain or collector voltage, and drain or collector current. In accordance with one embodiment, BJTs are used as active elements. A feedback circuit can be added to sense the output current, voltage or power and adjust the base current to control the output current, voltage or power. It will equalize the output power from the active elements and minimize the phase difference to achieve the maximum combining efficiency.

Figure 11:
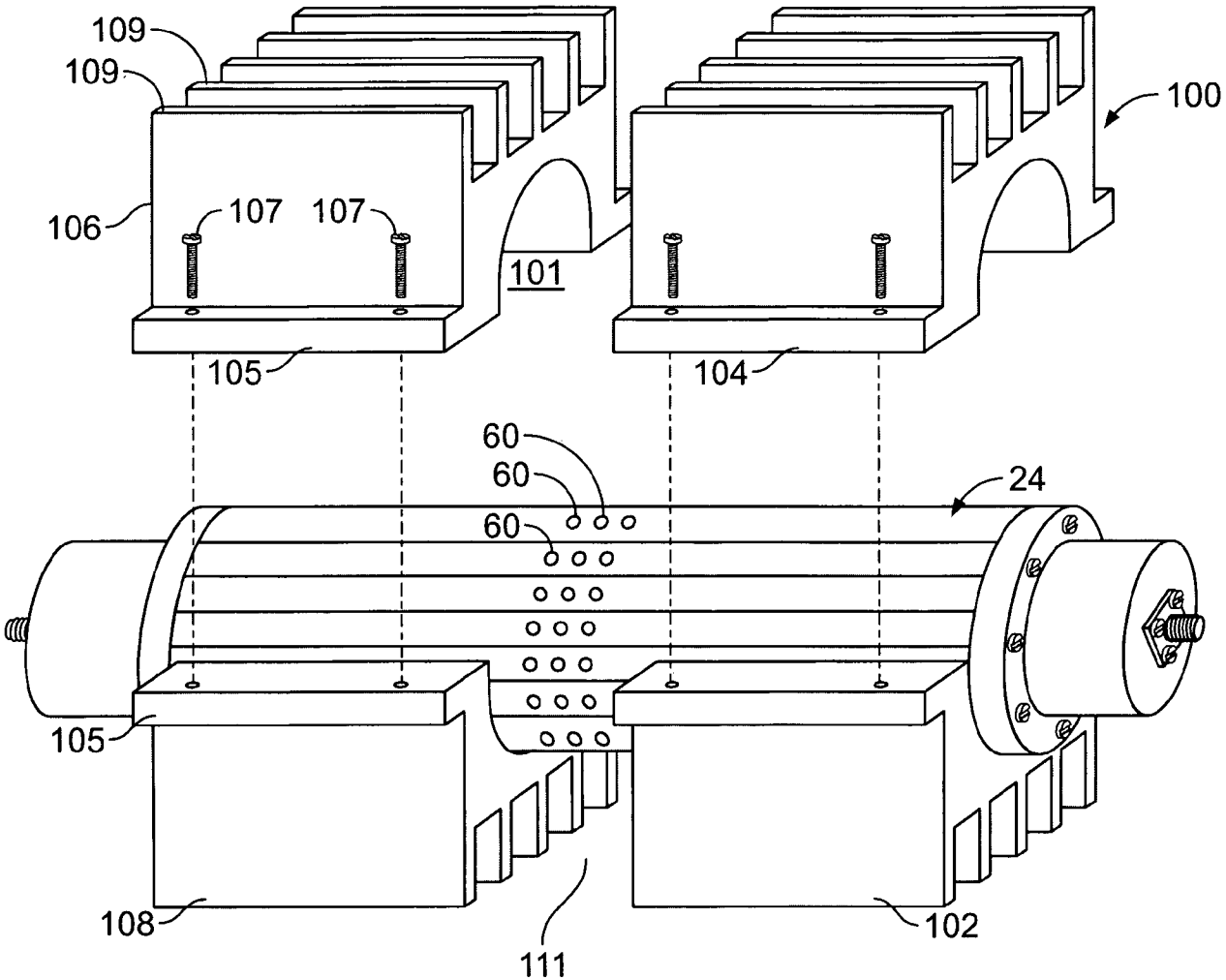
FIG. 11 is the perspective view of a thermal management scheme in accordance with the invention.

FIG. 11 shows a thermal management scheme for the power combining device. A heat sink 100 is comprised of two sections, with each section having a pair of separable halves defining a cavity 101 therebetween, the cavity having a shape which conforms to the outer shape of center waveguide section 24, which in the illustrated case is cylindrical. The halves delineated 102 and 104 are assembled together; and the halves delineated 106 and 108 assembled together. Flanges 105 are provided through which screws 107 or other fastening means pass to tighten the halves together. When mated together, each pair of halves defines a cylindrical or other shaped cavity conforming to the outer shape of center waveguide section 24. The heat sink is provided with fins 109, preferably formed in a machined manner. The height of the fins 109, along with the length of the heat sink, is determined by the amount of heat to be dissipated. The heat sink also operates to clamp the stacked trays together, making for a robust device even when significant vibration or other insult are encountered. A gap 111 between the two sections of the heat sink is provided for DC connections through holes 60 as discussed above. Thermal grease can be used to fill the gaps between the two pairs of separable halves of the heat sink. It will be appreciated that the heat sinks are not limited to two sections of two halves each; rather, more or less than two sections, each having more or subparts, can be used. Other connections of the subparts and different manufacturing techniques can be used.

Further, it will be appreciated that the teachings of the invention, including the hermetic sealing scheme, the power controlling scheme and the thermal management scheme can, can be applied to any known spatial power combining devices. These include a grid amplifier, an active array spatial power combiner, and all waveguide power combining devices using finline structure arrays. The finline structures include both slotline structures with necessary baluns and antipodal finline structures.

The length of the power combining device for broadband applications of the invention is mainly determined by the lower cut-off frequency of the operation frequency band. However, the teachings of the invention also apply for narrower bandwidth applications. The dimensions of the power combining device are changeable for different impedance matching levels and different frequency bandwidths. In the preferred embodiment, the input/output waveguide sections are about 2 inches in length. The wedge shaped trays 30 are each about 6 inches in length. However, it will be appreciated that other dimensions can be used, depending on desired frequency response and impedance matching level.

The above are exemplary modes of carrying out the invention and are not intended to be limiting. It will be apparent to those of ordinary skill in the art that modifications thereto can be made without departure from the spirit and scope of the invention as set forth in the following claims.

The invention claimed is:

1. A power combining device comprising:

an input port;

an input waveguide section in communication with the input port;

an output port;

an output waveguide section in communication with the output port; and a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein the center coaxial waveguide section comprises a plurality of trays disposed radially about the central axis, each tray including a carrier, generally wedge-shaped in cross-section, on which a pair of antipodal finline structures of the plurality of antipodal finline structures is mounted, and an active element of the plurality of active elements associated with said pair.

2. The device of claim 1, wherein the wedge-shaped cross-sectional shape of each carrier includes an arcuate outer side such that when the trays are assembled together the arcuate outer sides of the carriers combine to provide the center coaxial waveguide section with a substantially circular cross-sectional shape.

3. The device of claim 1, wherein the wedge-shaped cross-sectional shape of each carrier includes a planar outer side such that when the trays are assembled together the planar outer sides of the carriers combine to provide the center coaxial waveguide section with a substantially polygonal cross-sectional shape.

4. The device of claim 1, wherein the center coaxial waveguide section comprises 16 stacked trays whose carriers each having a wedge angle of about 22.5°.

5. A power combining device comprising:

an input port;

an input waveguide section in communication with the input port;

an output port;

an output waveguide section in communication with the output port; and a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein the center coaxial waveguide section comprises a plurality of trays disposed radially about the central axis, each tray including a carrier on which a pair of antipodal finline structures of the plurality of antipodal finline structures is mounted and an active element of the plurality of active elements associated with said pair, wherein each carrier includes a pair of cut-out regions defining a portion of a coaxial waveguide opening.

6. The device of claim 5, wherein the cut-out regions of each carrier are defined by arcuate major sides.

7. The device of claim 5, wherein the cut-out regions of each carrier are defined by planar major sides.

8. A power combining device comprising:

an input port;

an input waveguide section in communication with the input port;

an output port;

an output waveguide section in communication with the output port; and a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein the plurality of antipodal finline structures are provided with tapered profiles configured to optimize impedance matching between said center coaxial waveguide section and said active elements.

9. The device of claim 8, wherein the plurality of antipodal finline structures each comprise a substrate having a top side conductor which gradually changes in shape into a microstrip line and a back side conductor which gradually changes in shape into a continuous ground.

10. A power combining device comprising:

an input port;

an input waveguide section in communication with the input port;

an output port;

an output waveguide section in communication with the output port; and a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein the plurality of antipodal finline structures each comprise at least one antipodal finline taper, each taper connecting to at least one active element of the plurality of active elements.

11. The device of claim 10, wherein each taper connects to a plurality of active elements by a multi-way planar divider and combiner.

12. A power combining device comprising:

an input port;

an input waveguide section in communication with the input port;

an output port;

an output waveguide section in communication with the output port; and a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein the plurality of active elements include bare die chips and/or circuitry comprised of bare die chips.

13. A power combining device comprising an input port;

an input waveguide section in communication with the input port;

an output port;

an output waveguide section in communication with the output port; and a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein each of said plurality of active elements is a packaged active element.

14. The device of claim 13, wherein each of said packaged active elements is a surface mountable packaged active element.

15. The device of claim 13, wherein each of said packaged active elements is a hermetic packaged active element.

16. A power combining device comprising:

an input port;

an input waveguide section in communication with the input port;

an output port;

an output waveguide section in communication with the output port;

a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures; and a plurality of DC control circuits each associated with an active element of the plurality of active elements and operating to maximize combining efficiency by substantially unifying output power of the plurality of active elements.

17. A power combining device comprising:

an input port;

an input waveguide section in communication with the input port;

an output port;

an output waveguide section in communication with the output port;

a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein the center coaxial waveguide section comprises a plurality of trays disposed radially about the central axis, each tray including a carrier on which a pair of antipodal finline structures of the plurality of antipodal finline structures is mounted and an active element of the plurality of active elements associated with said pair; and a heat sink surrounding at least a portion of the center coaxial waveguide section, the heat sink including at least one section having two halves that are fastened together.

18. A power combining device comprising:

an input port;

an input waveguide section in communication with the input port;

an output port, an output waveguide section in communication with the output port; and a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein the center coaxial waveguide section comprises a plurality of trays disposed radially about the central axis, each tray including a carrier on which a pair of antipodal finline structures of the plurality of antipodal finline structures is mounted and an active element of the plurality of active elements associated with said pair, wherein each of said carriers has a top side on which a first pair of antipodal finline structures of the plurality of antipodal finline structures is mounted, and has a back side having a recess for accommodating an active element of the plurality of active elements that is associated with a second pair of antipodal finline structures of the plurality of antipodal finline structures, the second pair being mounted on a carrier of an adjacently-stacked tray.

19. A power combining device comprising:

an input port;

an input waveguide section in communication with the input port;

an output port;

an output waveguide section in communication with the output port; and a center coaxial waveguide section in communication with the input waveguide section and the output waveguide section, the center coaxial waveguide section having a central longitudinal axis and including a plurality of antipodal finline structures arranged radially about said central axis, and further including a plurality of active elements associated with the antipodal finline structures, wherein said input and output waveguide sections define coaxial waveguides.

20. The device of claim 19, wherein the coaxial waveguides defined by said input and output waveguide sections each include an inner conductor and an outer conductor, said inner and outer conductors predetermined tapered profiles.

21. A tray for use in a power combining device, said tray being stackable with other trays to thereby form a center coaxial waveguide of the power combining device, the tray comprising:

a wedge-shaped carrier having first and second cut-out regions;

an input antipodal finline structure mountable on a front side of the wedge-shaped carrier;

an output antipodal finline structure mountable on the front side of the wedge-shaped carrier; and a first active element coupling the input antipodal finline structure with the output antipodal finline structure, wherein the wedge-shaped carrier is provided with a recess on a back side thereof for receiving a second active element.

22. The device of claim 21, wherein the wedge-shaped carrier includes an arcuate outer side such that when the trays are assembled together the arcuate outer sides of the carriers combine to provide the center coaxial waveguide section with a substantially circular cross-sectional shape.

23. The device of claim 21, wherein the wedge-shaped carrier includes a planar outer side such that when the trays are assembled together the planar outer sides of the carriers combine to provide the center coaxial waveguide section with a substantially polygonal cross-sectional shape.

24. The device of claim 21, wherein each carrier includes a pair of cut-out regions defining a portion of a coaxial waveguide opening.

25. The device of claim 24, wherein the cut-out regions are defined by arcuate major sides.

26. The device of claim 24, wherein the cut-out regions of each carrier are defined by planar major sides.

27. The device of claim 21, wherein the antipodal finline structures are provided with tapered profiles configured to optimize impedance matching between said center coaxial waveguide section and said first active element.

28. The device of claim 27, wherein the antipodal finline structures each comprise a substrate having a top side conductor which gradually changes in shape into a microstrip line and a back side conductor which gradually changes in shape into a continuous ground.

29. The device of claim 21, wherein the antipodal finline structures each comprise at least one antipodal finline taper connected to the first active element.

30. The device of claim 29, further comprising a second active element to which the at least one antipodal finline is.

31. The device of claim 21 wherein the active element includes bare die chips and/or circuitry comprised of bare die chips.

32. The device of claim 21, wherein the active element is a packaged active element.

33. The device of claim 32, wherein the packaged active element is a surface mountable packaged active element.

34. The device of claim 32, wherein the packaged active element is a hermetic packaged active element.

35. The device of claim 21, wherein said input and output antipodal finline structures are part of a unitary component.

36. The device of claim 35, wherein the active element is mounted on the unitary component.

37. The device of claim 21, further including a DC control circuit connected to the active element and operating to maximize combining efficiency for the active element.

38. The device of claim 21, wherein the carrier has a wedge angle of about 22.5°.

39. A method for combining higher-power electromagnetic signals, comprising:

providing an input electromagnetic signal to an input waveguide section;

distributing the electromagnetic signal to a center coaxial waveguide section;

coupling the distributed electromagnetic signal in the center coaxial waveguide section to a plurality of antipodal finline structures arranged radially about a central longitudinal axis of the center coaxial waveguide section;

operating on said electromagnetic signal in each antipodal finline structure;

coupling the operated electromagnetic signal to an output waveguide section; and minimizing impedance mismatch in the input and output waveguide sections.

40. A method for combining high-power electromagnetic signals, comprising:

providing an input electromagnetic signal to an input waveguide section;

distributing the electromagnetic signal to a center coaxial waveguide section;

coupling the distributed electromagnetic signal in the center coaxial waveguide section to a plurality of antipodal finline structures arranged radially about a central longitudinal axis of the center coaxial waveguide section;

operating on said electromagnetic signal in each antipodal finline stricture;

coupling the operated electromagnetic signal to an output waveguide section; and passing the electromagnetic signal in each antipodal finline structure through a transition from a balanced finline to an unbalanced microstrip line.

41. A method for combining high-power electromagnetic signals, comprising:

providing an input electromagnetic signal to an input waveguide section;

distributing the electromagnetic signal to a center coaxial waveguide section;

coupling the distributed electromagnetic signal in the center coaxial waveguide section to a plurality of antipodal finline structures arranged radially about a central longitudinal axis of the center coaxial waveguide section;

operating on said electromagnetic signal in each antipodal finline structure;

coupling the operated electromagnetic signal to an output waveguide section; and passing the electromagnetic signal in each antipodal finline structure through a cavity whose dimensions are selected to avoid exciting resonance at higher frequency and avoid deteriorating lower frequency response.

42. A power combining device comprising:

an input waveguide section;

an output waveguide section; and a center waveguide section in communication with the input and output waveguide sections, the center waveguide section including a plurality of antenna structures each comprising:

an input antenna structure;

an output antenna structure;

an active element coupling the input antenna structure to the output antenna structure;

a control circuit connected to the active element and configured to equalize an output of the active element such that variations between outputs of active elements of different antenna structures are minimized.

43. The device of claim 42, wherein the input and output waveguide sections comprise coaxial waveguides.

44. The device of claim 42, wherein the input and output waveguide sections comprise rectangular waveguides.

45. The device of claim 42, wherein at least one of the input and output antenna structures is a finline structure.

46. The device of claim 45, wherein the finline structure is antipodal.

47. The device of claim 42, wherein at least one of the input and output antenna structures is a slotline structure.

48. The device of claim 42, wherein the active element is a field effect transistor (FET).

49. The device of claim 48, wherein the control circuit comprises a feedback loop operating to adjust a gate voltage of the FET such that a substantially fixed drain current is achieved.

50. The device of claim 42, wherein the control circuit comprises a power sensor configured to detect the power of the active element and lock said power substantially at a predetermined value.

51. A power combining device comprising:

an input waveguide section;

an output waveguide section;

a center waveguide section in communication with the input and output waveguide sections, the center waveguide section including a plurality of trays each accommodating an antenna structures having an active element mounted thereon; and a heat sink assembly comprising a plurality subparts adapted to be fastened together and to substantially surround at least a portion of the center waveguide section and clamp together the plurality of trays, wherein the heat sink is provided with an inner cavity substantially conforming to an outer shape of the center waveguide section.

52. The device of claim 51, wherein said outer shape is substantially cylindrical.

53. The device of claim 51, wherein said outer shape is polygonal cross-section.

* * * * *